US011542569B2

(12) United States Patent
Kang et al.

(10) Patent No.: US 11,542,569 B2
(45) Date of Patent: Jan. 3, 2023

(54) AUSTENITIC STAINLESS STEEL HAVING EXCELLENT PROCESSABILITY AND SURFACE CHARACTERISTICS, AND MANUFACTURING METHOD THEREFOR

(71) Applicant: POSCO, Pohang-si (KR)

(72) Inventors: Hyung-Gu Kang, Pohang-si (KR); Sang Jin Lee, Pohang-si (KR); Jae-Hong Shim, Seoul (KR); Yong-Heon Lee, Pohang-si (KR); Jong-Jin Jeon, Pohang-si (KR)

(73) Assignee: POSCO CO., LTD., Pohang-si (KR)

( * ) Notice: Subject to any disclaimer, the term of this patent is extended or adjusted under 35 U.S.C. 154(b) by 282 days.

(21) Appl. No.: 16/473,042

(22) PCT Filed: Dec. 21, 2017

(86) PCT No.: PCT/KR2017/015227

§ 371 (c)(1),
(2) Date: Jun. 24, 2019

(87) PCT Pub. No.: WO2018/117683

PCT Pub. Date: Jun. 28, 2018

(65) Prior Publication Data

US 2020/0087752 A1 Mar. 19, 2020

(30) Foreign Application Priority Data

Dec. 23, 2016 (KR) ..... 10-2016-0178365
Dec. 20, 2017 (KR) ..... 10-2017-0176063

(51) Int. Cl.

| | |
|---|---|
| ***C21D 9/46*** | (2006.01) |
| ***C22C 38/58*** | (2006.01) |
| ***C22C 38/44*** | (2006.01) |
| ***C22C 38/42*** | (2006.01) |
| ***C22C 38/02*** | (2006.01) |
| ***C22C 38/00*** | (2006.01) |
| ***C21D 9/00*** | (2006.01) |
| ***C21D 8/02*** | (2006.01) |
| ***C21D 6/00*** | (2006.01) |
| ***C21D 1/18*** | (2006.01) |

(52) U.S. Cl.

CPC ..... *C21D 9/46* (2013.01); *C21D 1/18* (2013.01); *C21D 6/004* (2013.01); *C21D 6/005* (2013.01); *C21D 6/008* (2013.01); *C21D 8/0205* (2013.01); *C21D 9/0081* (2013.01); *C22C 38/001* (2013.01); *C22C 38/02* (2013.01); *C22C 38/42* (2013.01); *C22C 38/44* (2013.01); *C22C 38/58* (2013.01); *C21D 2211/001* (2013.01)

(58) Field of Classification Search

CPC ..... C21D 9/46; C21D 1/18; C21D 6/004; C21D 6/005; C21D 6/008; C21D 8/0205; C21D 9/0081; C21D 2211/001; C22C 38/001; C22C 38/02; C22C 38/42; C22C 38/44; C22C 38/58; C23C 8/00

See application file for complete search history.

(56) References Cited

U.S. PATENT DOCUMENTS

| | | | | |
|---|---|---|---|---|
| 5,281,284 | A | 1/1994 | Ueda et al. | |
| 5,467,811 | A * | 11/1995 | Suehiro | B22D 11/0622 148/542 |
| 8,882,942 | B2 | 11/2014 | Furuya et al. | |
| 2014/0056751 | A1 | 2/2014 | Sakamoto et al. | |

FOREIGN PATENT DOCUMENTS

| | | | |
|---|---|---|---|
| JP | 5-59447 | A | 3/1993 |
| JP | H05-59447 | A | 3/1993 |
| JP | 7-268455 | A | 10/1995 |
| JP | H07-268453 | A | 10/1995 |
| JP | H07-268455 | A | 10/1995 |
| JP | H07268455 | A * | 10/1995 |
| JP | H07-292438 | A | 11/1995 |
| JP | H07292438 | A * | 11/1995 |
| JP | H08-300124 | A | 11/1996 |

(Continued)

OTHER PUBLICATIONS

Extended European Search Report dated Aug. 21, 2019 issued in European Patent Application No. 17885341.2.
Korean Office Action dated Jul. 4, 2019 issued in Korean Patent Application No. 10-2017-0176063.
Korean Notice of Allowance dated Aug. 12, 2019 issued in Korean Patent Application No. 10-2017-0176063 (with English translation).
Second Office Action issued in corresponding Chinese Patent Application No. 201780084380.3 dated Apr. 8, 2021, with English translation.
Communication issued in corresponding European Patent Application No. 17 885 341.2 dated Apr. 14, 2021.
International Search Report issued in corresponding Application No. PCT/KR2017/015227, dated Mar. 22, 2018.

(Continued)

*Primary Examiner* — Anthony M Liang
(74) *Attorney, Agent, or Firm* — Morgan, Lewis & Bockius LLP

(57) ABSTRACT

An austenitic stainless steel having excellent processability and surface characteristics and a method of manufacturing the austenitic stainless steel are disclosed. The austenitic stainless steel includes, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities, wherein a degree of Ni surface negative segregation defined by the following Formula (1) is in a range of 0.6 to 0.9.

$$(C_{Ni\text{-}Min})/(C_{Ni\text{-}Ave}) \quad \text{Formula (1),}$$

where $C_{Ni\text{-}Min}$ is a minimum concentration of Ni on the surface of the austenitic stainless steel and $C_{Ni\text{-}Ave}$ is an average concentration of Ni on the surface of the austenitic stainless steel.

6 Claims, 7 Drawing Sheets

(56) References Cited

FOREIGN PATENT DOCUMENTS

| | | | |
|---|---|---|---|
| JP | 10-85801 | A | 4/1998 |
| JP | 3090148 | B2 | 9/2000 |
| JP | 2001-254146 | A | 9/2001 |
| JP | 2002-309351 | A | 10/2002 |
| KR | 10-2003-0052367 | A | 6/2003 |
| KR | 10-2013-0014069 | A | 2/2013 |
| KR | 10-2014-0044318 | A | 4/2014 |
| KR | 10-2018-0073877 | A | 7/2018 |

OTHER PUBLICATIONS

Vietnamese Office Action dated Jun. 30, 2022 issued in Vietnamese Patent Application No. 1-2019-03327 (with English translation).

* cited by examiner

AUSTENITIC STAINLESS STEEL HAVING EXCELLENT PROCESSABILITY AND SURFACE CHARACTERISTICS, AND MANUFACTURING METHOD THEREFOR

TECHNICAL FIELD

The present disclosure relates to an austenitic stainless steel, and a manufacturing method of the same, and more particularly, to an austenitic stainless steel having excellent processability and surface characteristics and a manufacturing method of the same.

BACKGROUND ART

The present disclosure relates to a stainless steel used for sinks or the like, and more particularly, to an austenitic stainless steel having excellent processability and surface characteristics, which does not cause defects such as cracks and surface defects such as stripes, protrusions or the like, after processing into sinks.

Sink bowls of kitchen sinks are made of, generally, stainless steels. Specific general-purpose stainless steels are widely used as they have no problem in formability upon application to the shapes of general sink bowls.

However, recently, in order to enhance competitiveness in the market, many attempts to design sink bowls of various and complicated shapes have been made.

A material made of an austenitic stainless steel having poor processability makes defects such as cracks after processing. Furthermore, there are cases that the surface characteristics become poor due to protrusions formed on the surface after processing. Defects such as cracks or the like correspond to processing defects, which causes a decrease in production yield. When surface characteristics are poor, an additional process such as grinding is required, resulting in an increase of production cost.

For example, typically, STS 304 steel has been widely used for processing of sinks or the like. However, in the STS 304 steel, processing cracks and surface deterioration often occur as chronic problems.

Patent Document 1: Korean Patent Laid-Open Publication No. 10-2013-0014069 (Published on Feb. 6, 2013)

DISCLOSURE

Technical Problem

Embodiments of the present disclosure are to provide an austenitic stainless steel having excellent processability and surface characteristics, which does not cause processing cracks or surface deterioration even when being processed into a complicated shape such as a sink or the like, and a method of manufacturing the austenitic stainless steel.

Technical Solution

An austenitic stainless steel having excellent processability and surface characteristics according to an embodiment of the present disclosure may include, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities, wherein a degree of Ni surface negative segregation defined by the following Formula (1) may be in a range of 0.6 to 0.9.

$$(C_{Ni\text{-}Min})/(C_{Ni\text{-}Ave}) \quad \text{Formula (1),}$$

where $C_{Ni\text{-}Min}$ is a minimum concentration of Ni on the surface of the austenitic stainless steel and $C_{Ni\text{-}Ave}$ is an average concentration of Ni on the surface of the austenitic stainless steel.

Also, according to an embodiment of the present disclosure, the austenitic stainless steel may further include 0.01% to 0.2% of molybdenum (Mo) and 0.1% to 4.0% of copper (Cu).

Also, according to an embodiment of the present disclosure, a Ni surface segregation ratio defined by the following Formula (2) may be in a range of 1.1 to 1.6.

$$(C_{Ni\text{-}Max})/(C_{Ni\text{-}Min}) \quad \text{Formula (2),}$$

where $C_{Ni\text{-}Max}$ is a maximum concentration of Ni on the surface of the austenitic stainless steel, and $C_{Ni\text{-}Ave}$ is a minimum concentration of Ni on the surface of the austenitic stainless steel.

Also, according to an embodiment of the present disclosure, a Ni surface segregation portion may be less than 60% in area fraction, and a Ni surface negative segregation portion may be more than 5% in area fraction.

Also, according to an embodiment of the present disclosure, the Ni surface segregation portion may be a Ni-enriched region having a Ni concentration that is higher than the Ni average concentration on the surface, and the Ni surface negative segregation portion may be a Ni-depleted region having a Ni concentration that is lower than the Ni average concentration on the surface.

Also, according to an embodiment of the present disclosure, the Ni-enriched region may have a Ni concentration of 1.2 times or more of the average concentration of Ni on the surface, and the Ni-depleted region may have a Ni concentration of 0.8 times or less of the average concentration of Ni on the surface.

Also, according to an embodiment of the present disclosure, the Ni surface negative segregation portion may include segregation having a major diameter of 100/m or less by 60% or more.

Also, according to an embodiment of the present disclosure, the austenitic stainless steel may have a work-hardening speed H of 1,500 MPa to 3,000 MPa in the range of true strain 0.1 to 0.3.

Also, according to an embodiment of the present disclosure, the austenitic stainless steel may have an elongation of 60% or more.

A method for manufacturing an austenitic stainless steel having excellent processability and surface characteristics, according to an embodiment of the present disclosure, may include a step of continuously casting an austenitic stainless steel including, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities.

The step of continuously casting may include a step of cooling a slab at a rate of 60° C./min or more in a first temperature section of 1,150° C. to 1,200° C. in a secondary cooling zone, a step of cooling the slab at a rate of 10° C./min or less in a second temperature section of 900 to 1,1500° C., and a step of cooling the slab at a rate of 20° C./min or more in a third temperature section of 900° C. or less.

Also, according to an embodiment of the present disclosure, the method may further include a step of hot-rolling the slab cooled in the second temperature section and a step of cold-rolling the hot-rolled slab.

Also, according to an embodiment of the present disclosure, the step of hot-rolling may be performed by reheating the continuously casted slab of the austenitic stainless steel slab within 5 hours.

Also, according to an embodiment of the present disclosure, hot-rolled annealing or cold-rolled annealing may be performed by raising the temperature to an annealing temperature of 1,000° C. to 1,200° C. within 30 seconds and then maintaining for 30 seconds or less.

Advantageous Effects

An austenitic stainless steel according to embodiments of the present disclosure improves processability so as to prevent defects such as processing cracks even when being processed into a complicated shape such as a sink or the like and to prevent surface defects such as protrusions or stripes formed on the surface after processing.

BEST MODE

Figure 1:
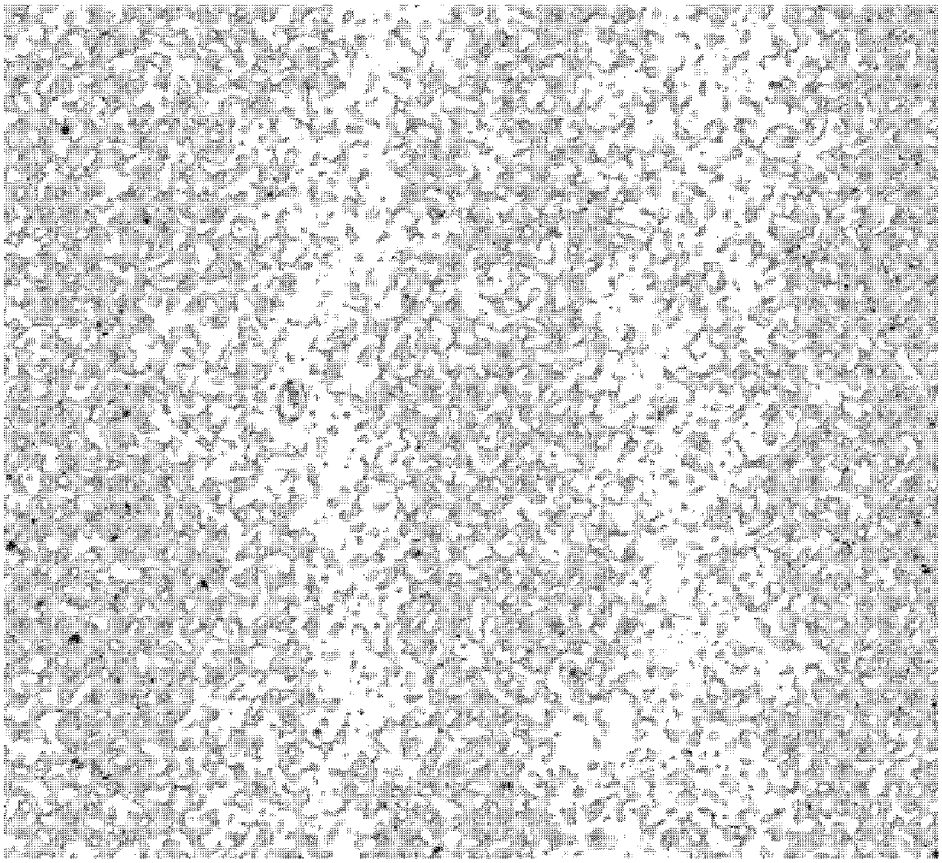
FIG. 1 is a photograph of a Ni segregation portion and a Ni negative segregation portion formed on the surface of an austenitic stainless steel according to an embodiment of the present disclosure.

An austenitic stainless steel having excellent processability and surface characteristics according to an embodiment of the present disclosure may include, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities, wherein a degree of Ni surface negative segregation defined by the following Formula (1) may be in a range of 0.6 to 0.9.

$$(C_{Ni\text{-}Min})/(C_{Ni\text{-}Ave}) \qquad \text{Formula (1),}$$

where, $C_{Ni\text{-}Min}$ is a minimum concentration of Ni on the surface of the austenitic stainless steel and $C_{Ni\text{-}Ave}$ is an average concentration of Ni on the surface of the austenitic stainless steel.

MODE OF THE DISCLOSURE

Hereinafter, embodiments of the present disclosure will be described in detail with reference to the accompanying drawings. These embodiments are provided to fully convey the concept of the present disclosure to those of ordinary skill in the art. The present disclosure may, however, be embodied in many different forms and should not be construed as limited to the exemplary embodiments set forth herein. In the drawings, parts unrelated to the descriptions are omitted for clear description of the disclosure and sizes of elements may be exaggerated for clarity.

An austenitic stainless steel having excellent processability and surface characteristics according to an embodiment of the present disclosure may include, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities. In addition, the austenitic stainless steel may further include, by weight %, 0.01% to 0.2% of molybdenum (Mo) and 0.1% to 4.0% of copper (Cu).

A reason of limiting numerical values of components constituting the austenitic stainless steel having excellent processability and surface characteristics, according to the present disclosure, will be described below.

C may be added within a range of 0.005 wt % to 0.15 wt %.

C which is austenite phase stabilizing element stabilizes an austenite phase as an addition amount of C increases. Accordingly, C of 0.005 wt % or more may be added. However, when an excessive amount of C is added, the strength increases excessively, and in this case, it may be difficult to process the austenite stainless steel. Therefore, C may be limited to 0.15 wt % or less.

Si may be added within a range of 0.1 wt % to 1.0 wt %.

Si provides a certain level of work hardening and corrosion resistance. Accordingly, Si of 0.1 wt % or more may be added. However, when an excessive amount of Si is added, toughness may deteriorate. Therefore, Si may be limited to 1.0 wt % or less.

Mn may be added within a range of 0.1 wt % to 2.0 wt %.

Mn which is an austenite phase stabilizing element stabilizes an austenite phase and reduce a work hardening rate as an addition amount of Mn increases. Accordingly, Mn of 0.1 wt % or more may be added. However, when an excessive amount of Mn is added, corrosion resistance may deteriorate. Therefore, Mn may be limited to 2.0 wt % or less.

Ni may be added within a range of 6.0 wt % to 10.5 wt %.

Ni which is an austenite phase stabilizing element stabilizes an austenite phase as an addition amount of Ni increases. In addition, when the addition amount of Ni increases, Ni reduces softening of the austenitic steel and reduces a work hardening rate. Further, in the present disclosure, Ni is an element forming a segregation region. Therefore, Ni of 6.0 wt % or more may be added. However, when an excessive amount of Ni is added, it may cause an increase in cost, and therefore, Ni may be limited to 10.5 wt %.

Cr may be added within a range of 16 wt % to 20 wt %.

Cr which is an element improving corrosion resistance may be added by 16 wt % or more. However, addition of an excessive amount of Cr may cause an increase in cost, and therefore, Cr may be limited to 20 wt %.

N may be added within a range of 0.005 wt % to 0.2 wt %.

N is an austenite phase stabilizing element. As a larger amount of N is added, the austenite phase is more stabilized and corrosion resistance is more improved.

Accordingly, N of 0.005 wt % or more may be added. However, when an excessive amount of N is added, the strength increases excessively, and in this case, it may be difficult to process the austenitic stainless steel. Therefore, N may be limited to 0.2 wt % or less.

Mo may be added within a range of 0.01 wt % to 0.2 wt %.

Mo improves corrosion resistance and processability. Accordingly, Mo of 0.01 wt % or more may be added. However, addition of an excessive amount of Mo may cause an increase in cost, and therefore, Mo may be limited to 0.2 wt % or less.

Cu may be added within a range of 0.1 wt % to 4.0 wt %.

Cu is an austenite phase stabilizing element. As a larger amount of Cu is added, the austenite phase is more stabilized, and softening of the austenite steel and a work-hardening rate is more reduced. Therefore, Cu of 0.1 wt % or more may be added. As a larger amount of Cu is added, the austenite phase is more stabilized, thereby obtaining characteristics pursued by the present disclosure. Therefore, Cu of 4.0 wt % or less may be added. However, addition of an excessive amount of Cu causes an increase in cost, and therefore, Cu may be limited to 2.0 wt %.

Figure 2:
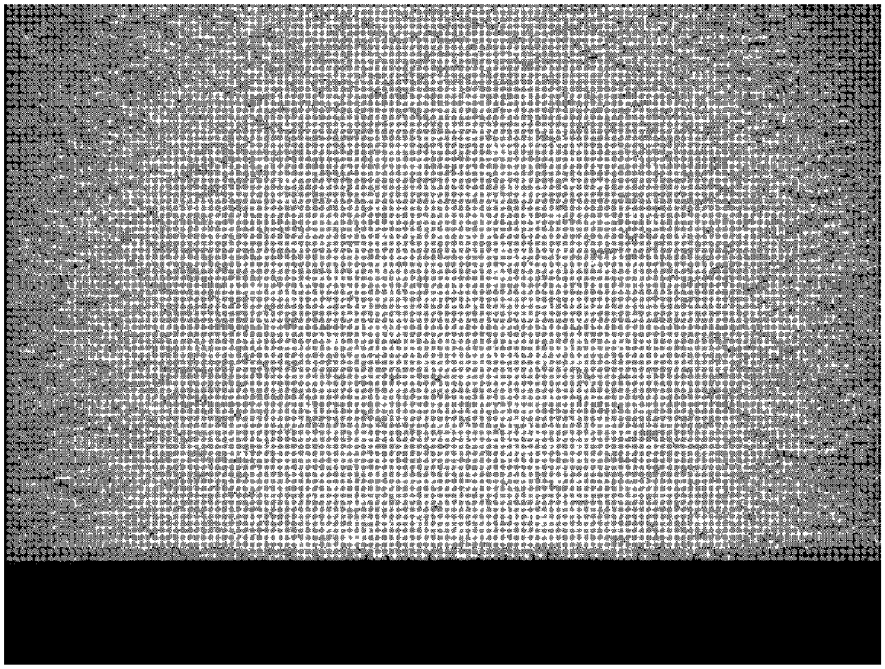
FIG. 2 is a photograph of the surface of a conventional austenitic stainless steel after processing.
Figure 3:
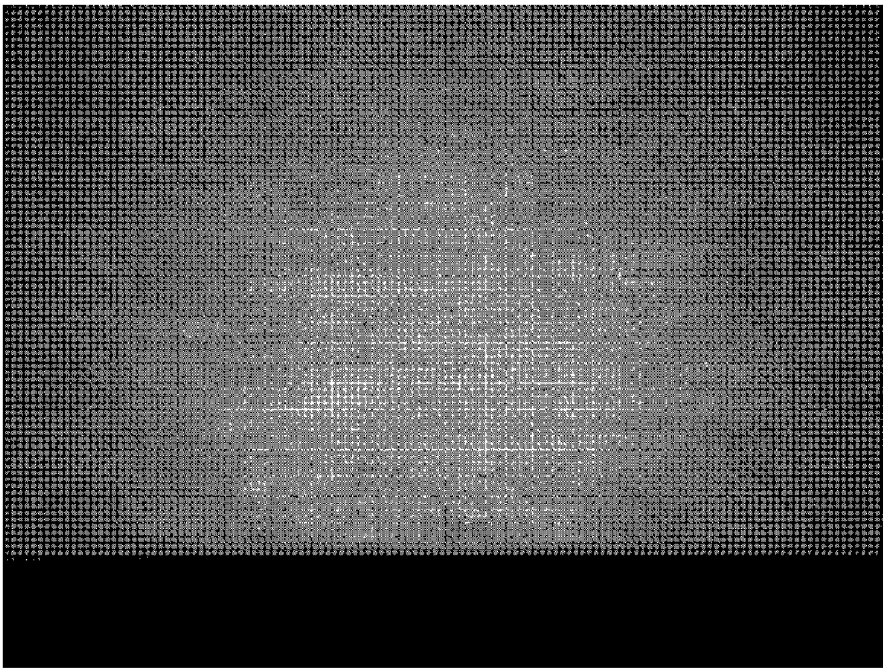
FIG. 3 is a photograph of the surface of an austenitic stainless steel after processing, according to an embodiment of the present disclosure.

FIG. 1 is a photograph of a Ni segregation portion and a Ni negative segregation portion formed on the surface of an austenitic stainless steel according to an embodiment of the present disclosure. FIG. 2 is a photograph of the surface of a conventional austenitic stainless steel after processing. FIG. 3 is a photograph of the surface of an austenitic stainless steel after processing, according to an embodiment of the present disclosure.

Referring to FIG. 1, an austenitic stainless steel having excellent processability and surface characteristics according to an embodiment of the present disclosure may include a Ni segregation portion and a Ni negative segregation portion on the steel surface. The Ni surface segregation portion is a Ni-enriched region having a higher concentration than a Ni average concentration at the surface. The Ni surface negative segregation portion is a Ni-depleted region having a lower concentration than the Ni average concentration at the surface. In FIG. 1, a bright color represents the Ni negative segregation portion, and a dark color represents the Ni segregation portion.

FIG. 2 is a photograph of the surface of STS 301 steel which is a conventional austenitic stainless steel. Referring to FIG. 2, the austenitic stainless steel has neither a Ni segregation portion nor a Ni negative segregation portion on the surface, and after the austenitic stainless steel is processed, protrusions are generated on the surface, which degrades the surface characteristics due to surface roughness.

On the other hand, FIG. 3 is a photograph of the surface of an austenitic stainless steel according to an embodiment of the present disclosure after processing. The austenitic stainless steel may have a Ni segregation portion and a Ni negative segregation portion on the surface, so that neither stripes nor protrusions are formed on the surface after processing, resulting in excellent surface quality.

The inventors of the present disclosure have estimated that, when a stainless steel having a Ni segregation portion is processed, martensitic transformation is made in a large amount in the negative segregation portion during processing, in comparison with a material containing the same amount of Ni but having no segregation portion, so that the formation of protrusions is suppressed.

That is, in the austenitic stainless steel according to an embodiment of the present disclosure, a degree of Ni surface negative segregation defined by the following Formula (1) may be in a range of 0.6 to 0.9.

$$(C_{Ni\text{-}Min})/(C_{Ni\text{-}Ave}) \qquad \text{Formula (1)},$$

where $C_{Ni\text{-}Min}$ is a minimum concentration of Ni on the surface and $C_{Ni\text{-}Ave}$ is an average concentration of Ni on the surface.

The degree of Ni surface negative segregation is defined by Formula (1), and obtained by dividing the minimum concentration of Ni on the surface of the steel by the average concentration of Ni on the surface of the steel. The minimum concentration of Ni may be measured at the Ni negative segregation portion.

Figure 4:
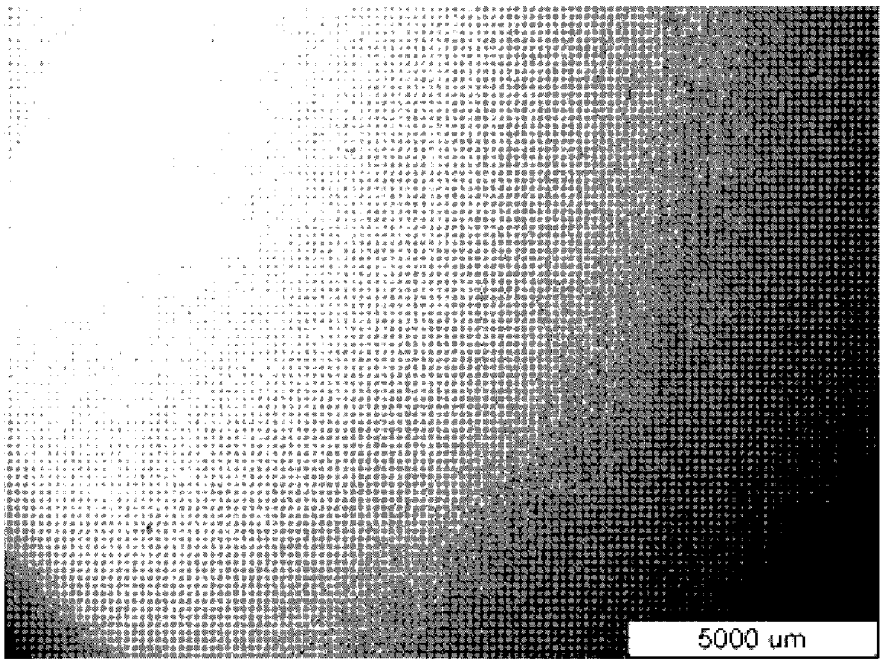
FIG. 4 is a photograph of the surface of an austenitic stainless steel after processing, according to a comparative example of the present disclosure.

FIG. 4 is a photograph of the surface of an austenitic stainless steel according to a comparative example of the present disclosure after processing.

When the degree of Ni surface negative segregation is less than 0.6, there is a problem that the segregation region is excessively formed on the surface so that severe stripes appear along the rolling direction on the surface after processing. FIG. 4 is a photograph of the surface of an austenitic stainless steel having a degree of Ni surface negative segregation of 0.5 after processing. Referring to FIG. 4, stripes are observed in the rolling direction, and surface defects due to such stripes increase the production cost by requiring additional processes such as polishing of the surface.

Also, when the degree of Ni surface negative segregation is more than 0.9, neither a segregation portion nor a negative segregation portion are formed, or formation amounts of the segregation portion and the negative segregation portion are so small that martensitic transformation does not occur in the negative segregation portion.

That is, in the austenitic stainless steel according to an embodiment of the present disclosure, a Ni surface segregation ratio defined by the following Formula (2) may be in a range of 1.1 to 1.6.

$$(C_{Ni\text{-}Max})/(C_{Ni\text{-}Min}) \qquad \text{Formula (2)},$$

where $C_{Ni\text{-}Max}$ is a maximum concentration of Ni on the surface and $C_{Ni\text{-}Ave}$ is a minimum concentration of Ni on the surface.

When the Ni surface segregation ratio is less than 1.1, neither a segregation portion nor a negative segregation portion are formed, or formation amounts of the segregation portion and the negative segregation portion are so small that martensitic transformation does not occur in the negative segregation portion.

Also, when the Ni surface segregation ratio is more than 1.6, a segregation region is excessively formed on the surface so that severe stripes appear along the rolling direction on the surface after processing, and surface defects due to such stripes increase the production cost by requiring additional processes such as polishing of the surface.

That is, the austenitic stainless steel according to an embodiment of the present disclosure may have the Ni surface segregation portion that is less than 60% in area fraction, and the Ni surface negative segregation portion that is more than 5% in area fraction.

The Ni surface segregation portion is a Ni-enriched region having a Ni concentration that is higher than the average Ni concentration on the surface, and the Ni surface negative segregation portion is a Ni-depleted region having a Ni concentration lower than the average Ni concentration on the surface. For example, the Ni-enriched region may have a Ni concentration of 1.2 times or more of the Ni average concentration on the surface, and the Ni-depleted region may have a Ni concentration of 0.8 times or less of the Ni average concentration on the surface.

When the Ni surface negative segregation portion is formed to have 5% or less in area fraction on the surface of the austenitic stainless steel, or the Ni surface segregation portion is formed to have 60% or more in area fraction on the surface of the austenitic stainless steel, martensitic transformation cannot sufficiently occur in the Ni surface negative segregation portion during processing so that it is difficult to suppress the formation of protrusions on the surface after processing.

For example, the Ni surface negative segregation portion may include segregation having a major diameter of 100 μm or less by 60% or more. Accordingly, as the segregation in the Ni surface negative segregation portion is refined, it is possible to prevent the generation of stripes along the rolling direction on the surface due to an increase in segregation size after processing, thereby improving the surface characteristics.

Also, the austenitic stainless steel according to an embodiment of the present disclosure may have a work hardening speed H of 1,500 MPa to 3,000 MPa in a range of true strain 0.1 to 0.3. Accordingly, the austenitic stainless steel according to an embodiment of the present disclosure may have an elongation of 60% or more.

The austenitic stainless steel may be excellent in processability when it is produced at the work hardening speed H of 1,500 MPa to 3,000 MPa in the range of true strain 0.1 to 0.3 of the material, with the Ni surface segregation portion and Ni surface negative segregation portion formed on the surface. The true strain and the work hardening speed may be calculated by a method widely defined in the academic world. The work hardening speed H is a value resulting from averaging a work hardening speed H calculated from general uniaxial tension in a predetermined section, that is, in a range of true strain of 0.1 to 0.3. The work hardening speed H may be calculated with the slope at every moment of the true strain-true stress graph, but the deviation of the value is significant. Therefore, the work hardening speed H may locally deviate from the range of 1,500 MPa to 3,000 MPa specified in the present disclosure, but consequently contributing to the material characteristics may be an average value of the work hardening speed H. The austenitic stainless steel may satisfy a work hardening speed H of 1,500 MPa to 3,000 MPa in the range of true strain 0.1 to 0.3.

Figure 5:
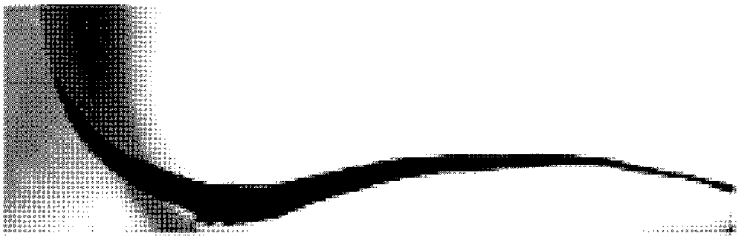
FIG. 5 is a photograph of a processed surface of a conventional austenitic stainless steel after sink processing.
Figure 6:
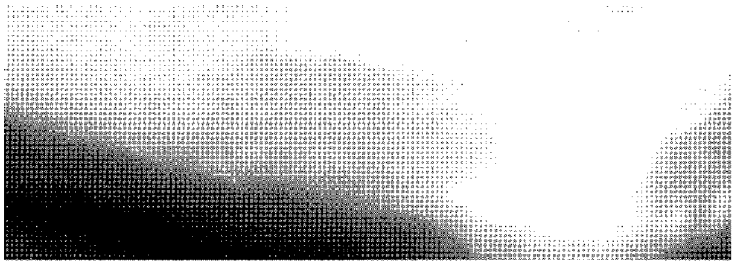
FIG. 6 is a photograph of a processed surface of an austenitic stainless steel according to an embodiment of the present disclosure after sink processing.

FIG. 5 is a photograph of a processed surface of a conventional austenitic stainless steel after sink processing. FIG. 6 is a photograph of a processed surface of an austenitic stainless steel according to an embodiment of the present disclosure after sink processing.

Most of materials pass a true strain section of 0.1 to 0.3 during processing. When a work hardening speed is higher than 3,000 MPa in the section, there are difficulties in processing due to excessive hardening of the material so that cracks occur as shown in the example of FIG. 5. In this case, it is found that the elongation, which is a representative index of processability, is less than 60%. Furthermore, when the working hardening speed is less than 1,500 MPa, the elongation is 60% or more, but there is a problem that wrinkles are generated due to excessive softening of the material. Therefore, it is preferable to control the working hardening speed. It can be seen that the material produced in the range suggested by the present disclosure has good sink processability as in the example of FIG. 6.

Figure 7:
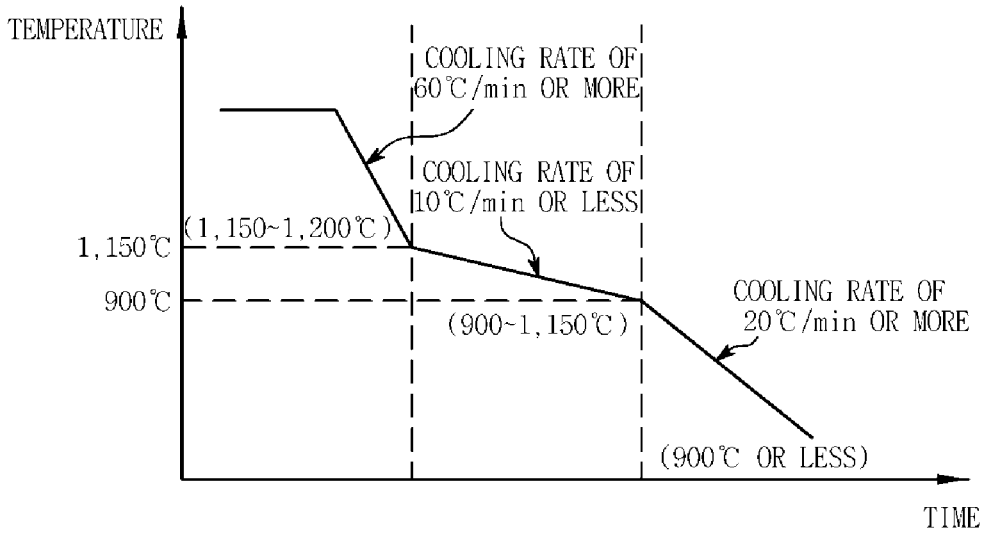
FIG. 7 is a graph for explaining a method of manufacturing an austenitic stainless steel according to an embodiment of the present disclosure.

FIG. 7 is a graph for explaining a method of manufacturing an austenitic stainless steel according to an embodiment of the present disclosure.

The method for manufacturing the austenitic stainless steel having excellent processability and surface characteristics, according to an embodiment of the present disclosure, may include a step of continuously casting an austenitic stainless steel including, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), the remainder iron (Fe) and other unavoidable impurities.

Referring to FIG. 7, the step of continuously casting may include a step of cooling a slab at a rate of 60° C./min or more in a first temperature section of 1,150° C. to 1,200° C. in a secondary cooling zone, a step of cooling the slab at a rate of 10° C./min or less in a second temperature section of 900° C. to 1,150° C., and a step of cooling the slab at a rate of 20° C./min or more in a third temperature section of 900° C. or less.

The continuously casted slab may be subjected to a step of cooling the slab at a rate of 60° C./min or more in the first temperature section of 1,150° C. to 1,200° C.

When the slab is produced by continuous casting from a molten steel having the component system of the present disclosure, quenching of the slab may be performed in the first temperature section so as to form a Ni surface segregation portion and a Ni surface negative segregation portion on the surface of the slab. For example, the entire surface of the slab may be cooled at a high rate through nozzle injection toward the front side. In contrast, when the slab is cooled at a rate of 60° C./min or less in the first temperature section, neither a Ni surface segregation portion nor a Ni surface negative segregation portion may be formed on the surface.

As the Ni segregation by continuous casting, central segregation of the slab is generally known, but when quenching is performed in a constant temperature section as in the present disclosure, Ni segregation may be formed on the surface of the slab.

Accordingly, in the austenitic stainless steel according to an embodiment of the present disclosure, the degree of Ni surface negative segregation expressed by Formula (1) may satisfy the range of 0.6 to 0.9, and the Ni surface segregation ratio expressed by Formula (2) may satisfy the range of 1.1 to 1.6.

Thereafter, the step of cooling the slab at a rate of 10° C./min or less in the second temperature section of 900° C. to 1,150° C. may be performed.

After the Ni segregation is formed on the surface in the first temperature section, slow cooling of the slab may be performed in the second temperature section. Accordingly, a part of the Ni segregation on the surface of the slab may become resoluble.

Accordingly, the Ni surface segregation portion of the austenitic stainless steel according to an embodiment of the present disclosure may be less than 60% in area fraction, and the Ni surface negative segregation portion may be more than 5% in area fraction.

Thereafter, the step of cooling the slab at a rate of 20° C./min or more in the third temperature section of 900° C. or less may be performed.

After a part of the Ni segregation becomes resoluble on the surface in the second temperature section, quenching of the slab may be performed in the third temperature section. Accordingly, segregation in the Ni surface negative segregation portion of the surface of the slab may be refined.

Accordingly, the Ni surface negative segregation portion may include segregation having a major diameter of 100 μm or less by 60% or more.

The method for manufacturing the austenitic stainless steel having excellent processability and surface characteristics according to an embodiment of the present disclosure may include a step of hot-rolling the slab cooled in the second temperature section and a step of cold-rolling the hot-rolled slab.

The hot-rolling may be performed by reheating the continuously casted slab of the austenitic stainless steel within 5 hours. When the reheating time of the slab exceeds 5 hours, the Ni surface segregation portion and the Ni surface negative segregation portion formed on the surface may start being decomposed so that the Ni surface negative segregation portion and the Ni surface segregation ratio of the present disclosure cannot be satisfied.

Further, hot-rolled annealing or cold-rolled annealing may be performed by raising the temperature to an annealing temperature of 1,000° C. to 1,200° C. within 30 seconds and then maintaining for 30 seconds or less. As the temperature raising time and the maintaining time for annealing increase upon hot-rolled annealing or cold-rolled annealing, the Ni surface segregation portion and the Ni surface negative segregation portion formed on the surface may start being decomposed so that the Ni surface negative segregation portion and the Ni surface segregation ratio of the present disclosure cannot be satisfied.

Hereinafter, the present disclosure will be described in more detail through embodiments.

Embodiments

Austenitic stainless steel slabs containing components of Inventive Examples 1 to 9 and Comparative Examples 1 to 6 as shown in Table 1 below were continuously casted. Thereafter, the steel slabs were subjected to hot-rolling and cold-rolling at a total reduction ratio of 50% to prepare cold-rolled steel sheets.

TABLE 1

| Sample | C | Si | Mn | Ni | Cr | Cu | Mo | N |
|---|---|---|---|---|---|---|---|---|
| Inventive Example 1 | 0.115 | 0.6 | 0.2 | 6.8 | 17.3 | 0.61 | 0.19 | 0.05 |
| Inventive Example 2 | 0.109 | 0.6 | 0.8 | 6.7 | 17.2 | 0.59 | 0.14 | 0.05 |
| Inventive Example 3 | 0.108 | 0.2 | 1.6 | 6.7 | 17.2 | 1.00 | 0.09 | 0.05 |
| Inventive Example 4 | 0.108 | 0.9 | 1.9 | 6.7 | 16.2 | 1.60 | 0.09 | 0.05 |
| Inventive Example 5 | 0.108 | 0.6 | 0.9 | 9.8 | 19.6 | 1.00 | 0.09 | 0.05 |
| Inventive Example 6 | 0.108 | 0.6 | 1.0 | 6.6 | 17.2 | 0.12 | 0.04 | 0.04 |
| Inventive Example 7 | 0.009 | 0.6 | 0.9 | 6.6 | 17.2 | 2.05 | 0.04 | 0.14 |
| Inventive Example 8 | 0.115 | 0.6 | 0.9 | 6.6 | 17.2 | 2.94 | 0.04 | 0.04 |
| Inventive Example 9 | 0.115 | 0.6 | 0.9 | 6.1 | 17.2 | 3.90 | 0.01 | 0.04 |
| Comparative Example 1 | 0.110 | 0.6 | 0.9 | 6.7 | 17.0 | 0.25 | 0.12 | 0.04 |
| Comparative Example 2 | 0.113 | 0.6 | 0.9 | 6.7 | 17.2 | 0.00 | 0.04 | 0.04 |
| Comparative Example 3 | 0.110 | 0.6 | 0.8 | 6.6 | 17.2 | 0.05 | 0.04 | 0.04 |
| Comparative Example 4 | 0.115 | 0.6 | 0.9 | 5.8 | 17.2 | 1.00 | 0.01 | 0.04 |
| Comparative Example 5 | 0.111 | 0.6 | 0.9 | 7.0 | 18.0 | 0.01 | 0.04 | 0.04 |
| Comparative Example 6 | 0.060 | 0.6 | 0.9 | 8.5 | 19.2 | 0.01 | 0.01 | 0.04 |

Accordingly, degrees of Ni surface negative segregation, segregation ratios, segregation sizes and distributions of the cold-rolled steel sheets, surface characteristics of the steel sheets after a processing test, and the occurrence of cracks or wrinkles of the steel sheets after processing were observed with the naked eye, and the observation results are shown in Table 2 below.

TABLE 2

| Sample | Degree of Ni Surface Negative Segregation | Ni Surface Segregation Ratio | Distribution of Segregation Having Major Diameter of 100 μm or less in Negative Segregation Portion (%) | Surface Characteristics | Processability |
|---|---|---|---|---|---|
| Inventive Example 1 | 0.90 | 1.1 | 90 | Good | Good |
| Inventive Example 2 | 0.67 | 1.5 | 65 | Good | Good |
| Inventive Example 3 | 0.90 | 1.1 | 90 | Good | Good |
| Inventive Example 4 | 0.63 | 1.6 | 65 | Good | Good |
| Inventive Example 5 | 0.71 | 1.4 | 70 | Good | Good |
| Inventive Example 6 | 0.67 | 1.5 | 65 | Good | Good |
| Inventive Example 7 | 0.83 | 1.2 | 85 | Good | Good |
| Inventive Example 8 | 0.90 | 1.1 | 90 | Good | Good |
| Inventive Example 9 | 0.90 | 1.1 | 90 | Good | Good |
| Comparative Example 1 | 0.53 | 1.9 | 55 | Stripes | Stripes |
| Comparative Example 2 | 0.59 | 1.7 | 60 | Stripes | Stripes |
| Comparative Example 3 | 0.56 | 1.8 | 55 | Stripes | Stripes |

TABLE 2-continued

| Sample | Degree of Ni Surface Negative Segregation | Ni Surface Segregation Ratio | Distribution of Segregation Having Major Diameter of 100 μm or less in Negative Segregation Portion (%) | Surface Characteristics | Processability |
|---|---|---|---|---|---|
| Comparative Example 4 | 0.45 | 2.2 | 45 | Stripes | Stripes |
| Comparative Example 5 | 1.00 | 1.0 | — | Protrusions | Protrusions |
| Comparative Example 6 | 1.00 | 1.0 | — | Protrusions | Protrusions |

Herein, the degrees of Ni surface negative segregation and the segregation ratios were measured on the surfaces of the austenitic stainless steels. The measured surfaces were surfaces with axes of the rolling direction and the width direction, that is, surfaces commonly referred to as rolling surfaces. In order to have statistical significance, the length of each axis was set to 500 μm or more, and 50 or more points were measured at equal intervals on each axis. As a measurement method, any one of energy dispersive spectroscopy (EDS) or electron probe micro analysis (EPMA) can be used, and elemental distributions of Ni were measured by the EPMA in areas of 800 μm*800 μm. Because stainless steels generally form oxide layers on the surfaces, when the reaction volume is not sufficient enough for an element measuring apparatus to measure areas below the oxide layer, surfaces resulting from polishing the oxide layer to 1 μm to 200 μm from the surface are measured. Also, foreign materials are out of the scope of the present disclosure, and Ni segregation is for a base material.

Referring to Table 1 and Table 2, it can be seen that, when the composition and the compositional range of the austenitic stainless steel according to an embodiment of the present disclosure are satisfied, surface characteristics and processability are excellent. However, it can be seen that, when the degree of Ni surface negative segregation or the Ni segregation ratio of the steel surface is not satisfied although the compositional range is satisfied, surface characteristics or processability deteriorates.

Further, additional experiments were conducted to confirm a correlation between the work hardening speed H and the sink processability. Accordingly, sink processing was performed on the prepared cold-rolled steel sheets. The work hardening speeds H and elongations of the steel sheets were measured, and the occurrence of cracks or wrinkles after processing was observed with the naked eye, and the observation results are shown in Table 3, below.

TABLE 3

| Sample | Work Hardening Speed H | Elongation (%) | Sink Processability |
|---|---|---|---|
| Inventive Example 1 | 2990 | 60.8 | good |
| Inventive Example 2 | 2462 | 65.5 | good |
| Inventive Example 3 | 1979 | 67.0 | good |
| Comparative Example 1 | 4684 | 47.4 | cracked |
| Comparative Example 2 | 3747 | 53.7 | cracked |
| Comparative Example 3 | 1474 | 64.8 | wrinkled |

TABLE 3-continued

| Sample | Work Hardening Speed H | Elongation (%) | Sink Processability |
|---|---|---|---|
| Comparative Example 4 | 1372 | 64.6 | wrinkled |

Therefore, it will be understood that the austenitic stainless steel which has excellent sink processability to cause neither cracks nor wrinkles on the surface after processing is manufactured such that it satisfies the work hardening speed H of 1,500 MPa to 3,000 MPa in the range of true strain 0.1 to 0.3.

While the present disclosure has been particularly described with reference to exemplary embodiments, it should be understood by those skilled in the art that various changes in form and details may be made without departing from the spirit and scope of the present disclosure.

INDUSTRIAL APPLICABILITY

The austenitic stainless steel having excellent processability and surface characteristics according to embodiments of the present disclosure is applicable to sink bowls of kitchen sinks or the like.

What is claimed is:

1. An austenitic stainless steel comprising, by weight %, 0.005% to 0.15% of carbon (C), 0.1% to 1.0% of silicon (Si), 0.1% to 2.0% of manganese (Mn), 6.0% to 10.5% of nickel (Ni), 16% to 20% of chromium (Cr), 0.005% to 0.2% of nitrogen (N), 0.01% to 0.2% of molybdenum (Mo), 0.1% to 4.0% of copper (Cu), the remainder iron (Fe) and other unavoidable impurities, including a Ni surface segregation portion which is a Ni-enriched region having a Ni concentration that is higher than an average Ni concentration on a surface, and a Ni surface negative segregation portion which is a Ni-depleted region having a Ni concentration that is lower than the average Ni concentration on the surface, wherein a degree of Ni surface negative segregation defined by the following Formula (1) is in a range of 0.6 to 0.83, wherein a Ni surface segregation ratio defined by the following Formula (2) is in a range of 1.1 to 1.6, $$(C_{Ni\text{-}Min})/(C_{Ni\text{-}Ave}) \quad \text{Formula (1)},$$

$$(C_{Ni\text{-}Max})/(C_{Ni\text{-}Min}) \quad \text{Formula (2)},$$

where $C_{Ni\text{-}Min}$ is a minimum concentration of Ni on the surface of the austenitic stainless steel, the minimum concentration of Ni is measured at the Ni negative segregation portion, and $C_{Ni\text{-}Ave}$ is an average concentration of Ni on the surface of the austenitic stainless steel, and $C_{Ni\text{-}Max}$ is a maximum concentration of Ni on the surface of the austenitic stainless steel.

2. The austenitic stainless steel according to claim 1, wherein a Ni surface segregation portion is less than 60% in area fraction, and a Ni surface negative segregation portion is more than 5% in area fraction.

3. The austenitic stainless steel according to claim 1, wherein the Ni-enriched region has a Ni concentration of 1.2 times or more of the Ni average concentration on the surface, and the Ni-depleted region has a Ni concentration of 0.8 times or less of the Ni average concentration on the surface.

4. The austenitic stainless steel according to claim 2, wherein the Ni surface negative segregation portion comprises at least 60% of a Ni segregation having a major diameter of 100 μm or less.

5. The austenitic stainless steel according to claim 1, wherein the austenitic stainless steel has a work hardening speed H of 1,500 MPa to 3,000 MPa in a range of true strain 0.1 to 0.3.

6. The austenitic stainless steel according to claim 5, wherein the austenitic stainless steel has an elongation of 60% or more.

* * * * *